US006250745B1

(12) United States Patent
Umemura et al.

(10) Patent No.: US 6,250,745 B1
(45) **Date of Patent: *Jun. 26, 2001**

(54) INK CARTRIDGE FOR PRINTERS

(75) Inventors: Shunji Umemura; Masahiko Chino, both of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/905,163

(22) Filed: Aug. 1, 1997

(30) Foreign Application Priority Data

Aug. 21, 1996 (JP) ..... 8-238389

(51) Int. Cl.[7] ..... B41J 2/175
(52) U.S. Cl. ..... 347/86
(58) Field of Search ..... 347/86, 87, 84, 347/85; 53/489, 412, 478, 319, 264

(56) References Cited

U.S. PATENT DOCUMENTS 5,244,087 * 9/1993 Hikake et al. ..... 347/87
5,589,862 * 12/1996 Ujita et al. ..... 347/87
5,604,523 * 2/1997 Tsukuda et al. ..... 347/86
5,661,510 * 8/1997 Brandon et al. ..... 347/87
5,671,000 * 9/1997 Hirabayashi et al. ..... 347/86
5,784,088 * 7/1998 Ujita et al. ..... 347/86
5,831,652 * 11/1998 Hinami et al. ..... 347/86

FOREIGN PATENT DOCUMENTS 0 605 183 * 7/1994 (EP) ..... 347/86
59-143647 8/1984 (JP) .
2-198862 8/1990 (JP) .
5-104735 4/1993 (JP) .
5-162326 * 6/1993 (JP) ..... 347/86
7-137277 5/1995 (JP) .
8-132636 5/1996 (JP) .

* cited by examiner

*Primary Examiner*—N. Le
*Assistant Examiner*—Judy Nguyen
(74) *Attorney, Agent, or Firm*—Hogan & Hartson, LLP

(57) ABSTRACT

There is provided an ink cartridge which prevents ink from spilling out when the ink cartridge is mounted in a printer. An ink supply block of the ink cartridge is formed with a delivery port opening in a bottom of the ink supply block and a supply passage extending inward from the delivery port. A filter is provided at an upstream end of the supply passage. A lid member, which has a complementary shape to the supply passage, is removably mounted in the supply passage from the delivery port.

13 Claims, 11 Drawing Sheets

INK CARTRIDGE FOR PRINTERS

BACKGROUND OF THE INVENTION

1. Field of the Invention

This invention relates to an ink cartridge which is removably mounted in ink jet printers.

2. Related Art

FIG. 1 shows an ink cartridge. The ink cartridge 100 has a cartridge casing 101 comprised of an upper casing 102 and a lower casing 103. The cartridge casing 101 contains ink absorbent 104. The lower casing 103 has a bottom formed with an ink supply block 105 projecting downward. The ink supply block 105 is constructed such that it can be fitted on an inserting portion of a print head of a printer, through which ink is introduced into the print head, so as to facilitate coupling of the ink cartridge 100 to the print head and make it possible to mount the cartridge 100 even in a printer which is subject to vibration. More specifically, the ink supply block 105 is formed with a delivery port 106 opening in a bottom surface thereof, and a supply passage 107 which extends from the delivery port 106 to the inside of the cartridge casing 101 and serves both as an ink passage and as a portion for receiving the inserting portion of the print head. Further, at an upstream end of the supply passage 107, there is provided a filter 108 in a manner separating the supply passage 107 and the ink absorbent 104 from each other. On the other hand, the upper casing 102 is formed therethrough with an ink-charging port 109, and on a top surface of the upper casing 102, there is formed a meandering air groove 110 leading to the ink-charging port 109.

The delivery port 106 of the ink cartridge 100 constructed as above is covered with a delivery port-covering film 111 by attaching the same to the bottom surface thereof by thermo compression bonding. Then, the ink cartridge 100 is put in a vacuum chamber, where ink is charged into the ink cartridge 100 via the ink-charging port 109. Further, an ink-charging port-covering film 112 is attached to the top surface of the upper casing 102 by thermo compression bonding, to thereby block the ink-charging port 109 and cover the air groove 110. In this state, the cartridge 100 is enclosed in a sealed package, and supplied to users. Before mounting the ink cartridge 100 in a printer, the user peels off part of the ink-charging port-covering film 112 to thereby expose an open end of the air groove 110 to the atmosphere, and then opens the delivery port 106 by peeling off the delivery port-covering film 111. In this state, the ink cartridge 100 is fitted on the inserting portion of the print head of the printer.

In the case of the ink cartridge 100 described above, when ink is charged into the cartridge 100, the ink flows through the filter 108 to fill the supply passage 107. Therefore, before mounting the cartridge 100 in the printer, when the user, after peeling off the ink-charging port-covering film 112, turns the ink cartridge 100 upside down and peels off the delivery port-covering film 111, the ink collected in the supply passage 107 is liable to spill out and stain the user's hands. Further, the ink also tends to spill out when the user turns the ink cartridge 100 over again to fit the same on the inserting portion of the print head, so that the user has to remove the collected ink from the supply passage 107 before using the cartridge 100. This makes the mounting of the cartridge 100 very troublesome.

SUMMARY OF THE INVENTION

It is an object of the invention to provide an ink cartridge for a printer, which is capable of preventing ink from spilling out when the cartridge is mounted in the printer.

To attain the above object, according to a first aspect of the invention, there is provided an ink cartridge for a printer, comprising:

an ink supply block via which ink is supplied to the printer, the ink supply block being formed with a delivery port opening in a bottom of the ink supply block, and a supply passage extending from the delivery port to an inside of the ink cartridge;

a filter provided at an upstream end of the supply passage; and a lid member having a complementary shape to the supply passage and removably mounted in the supply passage from the delivery port.

According to this ink cartridge, since the lid member mounted in the supply passage has a complementary shape to the supply passage, ink charged into the cartridge is prevented from flowing into the supply passage. Therefore, when the lid member is removed before mounting of the cartridge in a printer, the supply passage is empty, i.e. contains no collected ink, so that there is no fear of ink spilling out therefrom.

Preferably, the lid member is formed by a solid member for blocking the supply passage.

According to this preferred embodiment, the supply passage is blocked with the lid member in such a manner that there is substantially no clearance between the lid member and the inner walls of the supply passage. Therefore, if the lid member is formed of a non-ink-absorbent material, ink is not permitted to flow into the supply passage, while if the lid member is formed of an ink absorbent material, ink is absorbed therein. That is, in both cases, there is no fear of the ink being collected in the supply passage.

More preferably, the lid member has a seizing portion provided thereon for removing the lid member from the ink cartridge.

According to this preferred embodiment, the seizing portion enables the lid member to be removed from the supply passage with ease.

Further preferably, the seizing portion is formed by a film-like member firmly affixed to a surface of the lid member on a side of the delivery port, and the film-like member is removably adhered to a bottom end of the ink supply block for sealing the delivery port.

According to this preferred embodiment, it is possible to remove the lid member together with the film-like member simply by peeling off the latter, and at the same time, prevent ink from leaking out through the clearance between the lid member and the inner walls of the supply passage even if the ink cartridge is handled violently e.g. during transport.

Preferably, the ink cartridge includes an ink-charging block corresponding to the ink supply block and a cover film for removably covering an air inlet port formed in the ink-charging block, the cover film and the film-like member being formed in one piece.

According to this preferred embodiment, the cover film on the side of the ink-charging block as well as the film-like member and lid member on the side of the ink supply block can be removed together in a single step. Therefore, it is possible to make the ink cartridge ready for mounting in a printer quickly, as well as prevent the user from carelessly failing to remove the cover film or the lid member from the cartridge before it is mounted in the printer.

Still preferably, the lid member is formed of any of rubber, polypropylene, or an absorbent material.

In another preferred embodiment, the lid member is formed by a thin member having a complementary outer shape to the supply passage.

According to this preferred embodiment, since the lid member formed by the thin member has a complementary outer shape to the supply passage, the lid member is in intimate contact with the whole inner walls of the supply passage. Therefore, ink charged into the ink cartridge is blocked by the thin member from flowing into the supply passage. Further, when the lid member is removed from the supply passage before mounting of the ink cartridge in a printer, the supply passage is empty, i.e. contains no ink collected therein, so that there is no fear of ink spilling out therefrom.

More preferably, the lid member has a periphery thereof removably affixed to the bottom end of the ink supply block for sealing the delivery port.

According to this preferred embodiment, it is possible to prevent ink from leaking out through the clearance between the lid member and the inner walls of the supply passage even if the ink cartridge is handled violently e.g. during transport.

Further preferably, the periphery of the lid member extends beyond an edge of the bottom end of the ink supply block.

According to this preferred embodiment, it is possible to seize the periphery of the lid member and pull the portion to thereby remove the whole lid member with ease.

Further preferably, the ink cartridge includes an ink-charging block corresponding to the ink supply block and a cover film for removably covering an air inlet port formed in the ink-charging block, the cover film and the lid member being formed in one piece.

According to this preferred embodiment, the cover film on the side of the ink-charging block and the lid member on the side of the ink supply block are removed together in a single step. Therefore, it is possible to make the ink cartridge ready for mounting in a printer quickly, as well as prevent the user from carelessly failing to remove the cover film or the lid member from the cartridge before it is mounted in the printer.

Further preferably, the thin member is formed of a sheet material.

According to this preferred embodiment, the lid member has enough thickness for being easily shaped complementary to the supply passage such that no clearance is produced between the lid member and the inner wall of the supply passage.

Still preferably, the sheet material is made of polyethylene terephthalate.

To attain the above object, according to a second aspect of the invention, there is provided an ink cartridge for a printer, comprising:

an ink supply block via which ink is supplied to the printer, the ink supply block being formed with a plurality of delivery ports each opening in a bottom of the ink supply block, and a plurality of supply passages respectively extending from the plurality of delivery ports to an inside of the ink cartridge;

a plurality of filters provided at respective upstream ends of the supply passages; and a plurality of lid members each having a complementary shape to each of the supply passage and removably mounted in the each of the supply passage from the delivery port.

According to this ink cartridge, each of the plurality of supply passages has the lid member mounted therein. Therefore, it is possible to prevent ink from being collected in the supply passages, which eliminates fear of ink spilling out therefrom when the lid members are removed before mounting of the ink cartridge in a printer.

Preferably, the plurality of lid members are formed in one piece.

According to this preferred embodiment, since the plurality of lid members are formed in one piece, it is possible to remove the lid members together in a single step.

More preferably, the plurality of lid members are affixed to an inner surface of a package for enclosing the ink cartridge therein.

According to this preferred embodiment, it is possible to remove the plurality of lid members together in a single step when the ink cartridge is taken out of the package, so that the user is positively prevented from failing to remove the lid members from the ink cartridge before mounting the ink cartridge in a printer.

In another preferred embodiment, the ink cartridge device includes a film-like member for connecting the plurality of lid members.

According to this preferred embodiment, it is possible to remove the film-like member and the plurality of lid members together in a single step by removing the film-like member from the ink cartridge.

More preferably, the film-like member serves as part of the package for the ink cartridge.

According to this preferred embodiment, it is possible to remove the plurality of lid members together in a single step when the ink cartridge is taken out of the package, so that the user is positively prevented from failing to remove the lid members from the ink cartridge before mounting the ink cartridge in a printer. In addition, the member of component parts can be reduced.

In still another preferred embodiment, the plurality of lid members are formed by a thin member in one piece.

According to this preferred embodiment, since the plurality of lid members are formed by the thin member in one piece, it is possible to remove the lid members together in a single step.

More preferably, the plurality of lid members serve as part of the package for the ink cartridge.

According to this preferred embodiment, it is possible to remove the plurality of lid members together in a single step when the ink cartridge is taken out of the package, so that the user is positively prevented from failing to remove the lid members from the ink cartridge before mounting the ink cartridge in a printer.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
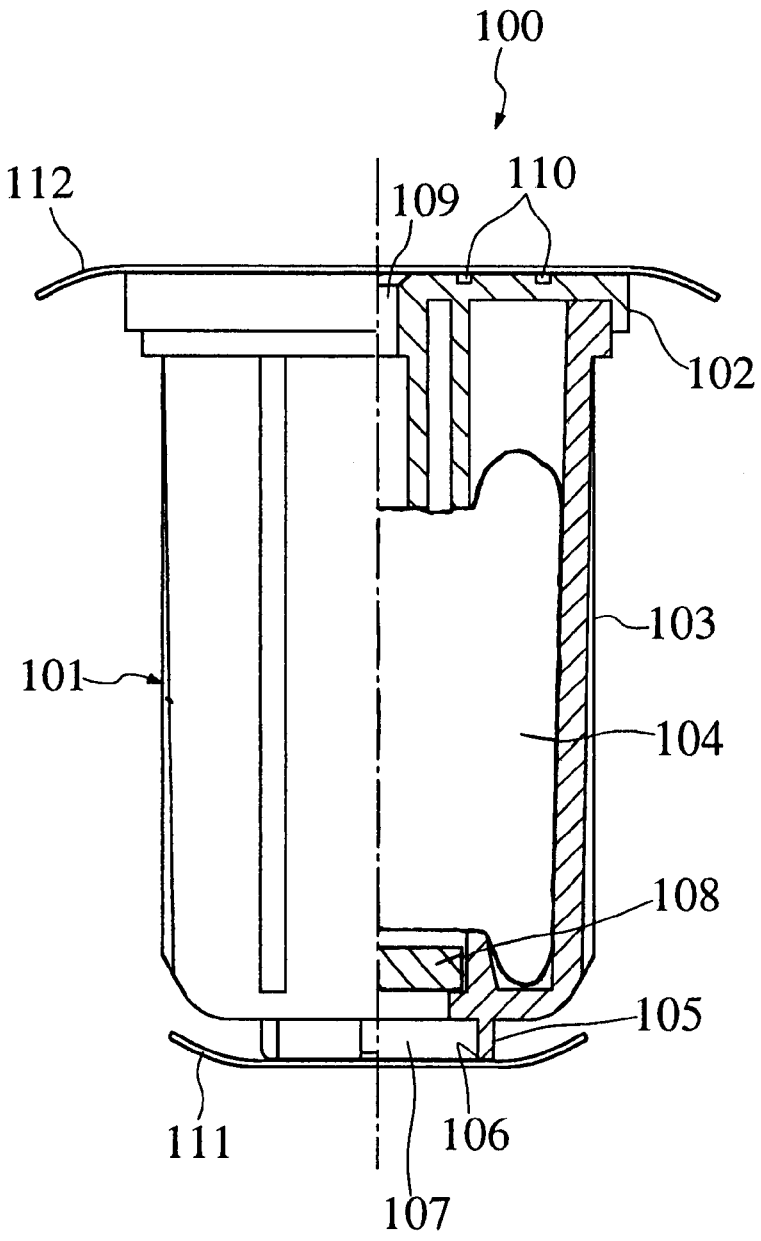
FIG. 1 is a side elevational view partially in section showing an ink cartridge in storage.
Figure 2:
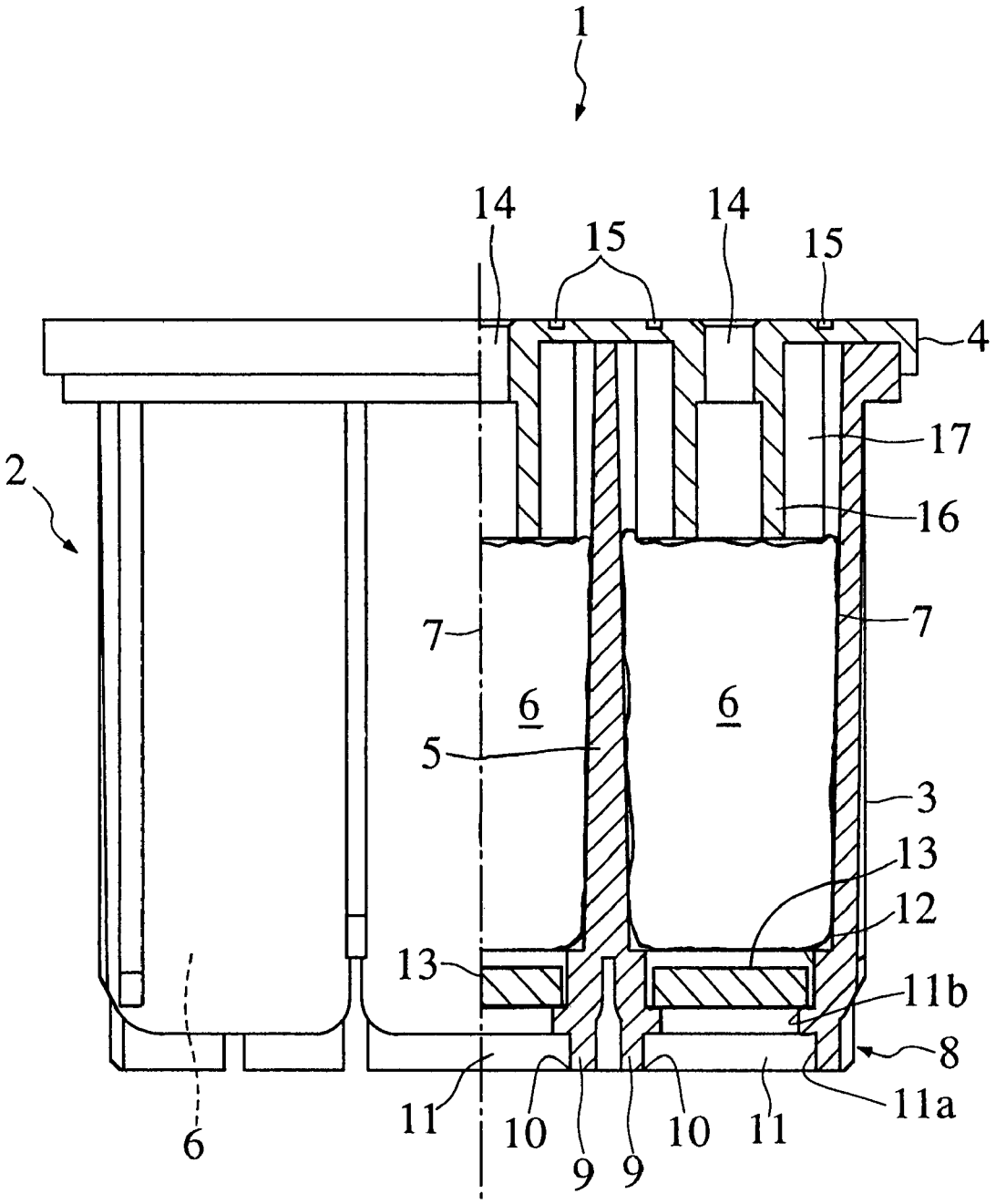
FIG. 2 is a front elevational view partially in section showing an ink cartridge according to a first embodiment of the invention.
Figure 3:
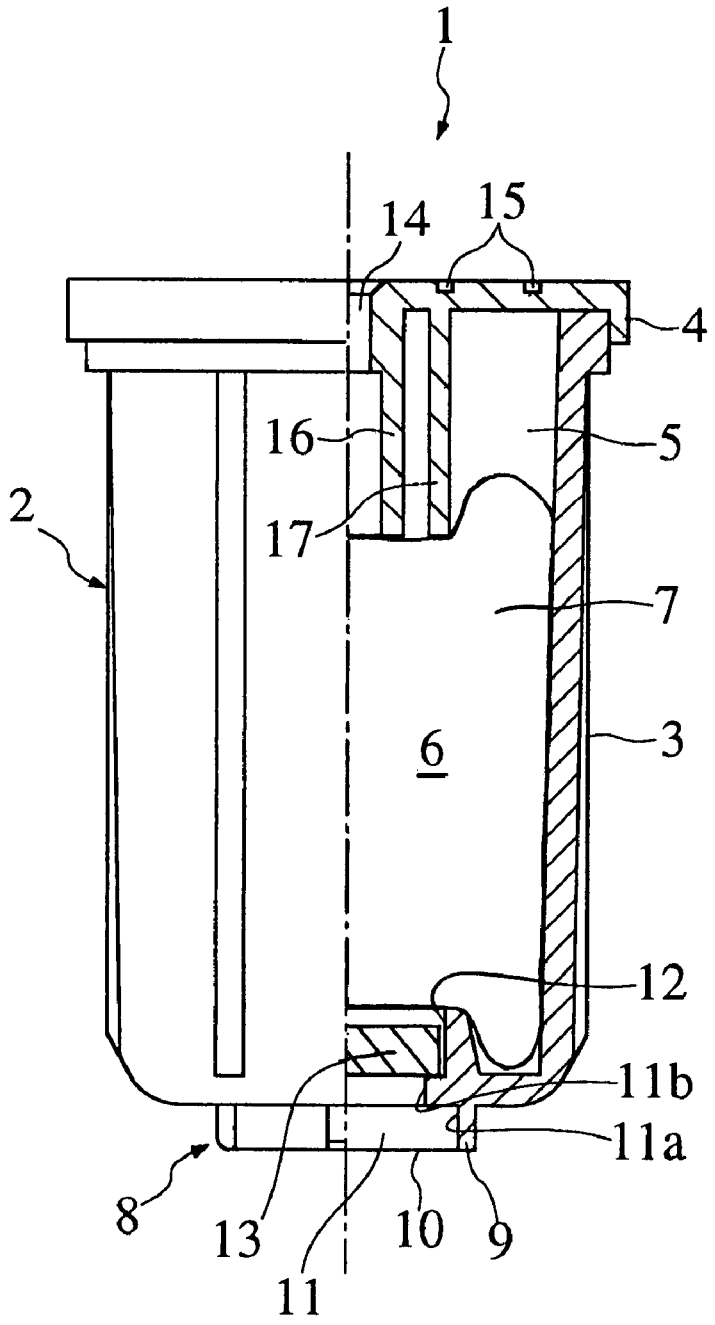
FIG. 3 is a side elevational view partially in section showing the ink cartridge according to the first embodiment of the invention.
Figure 4:
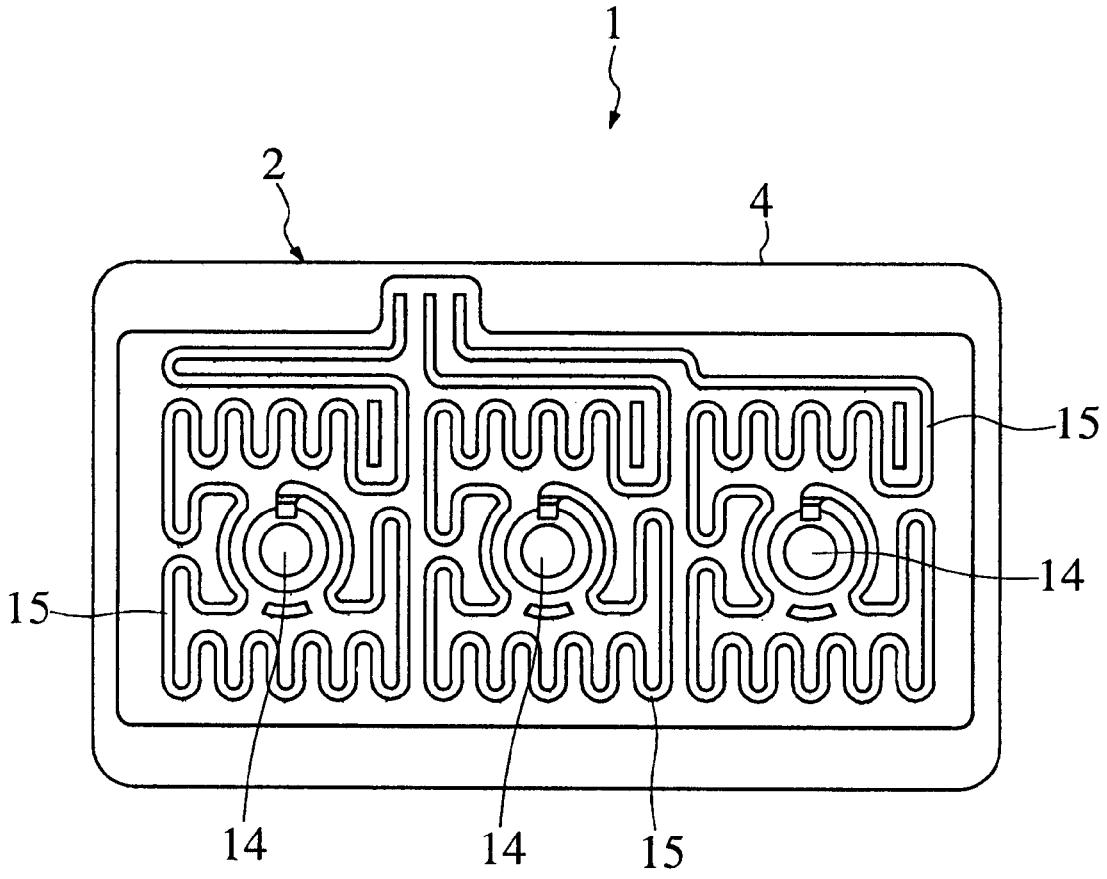
FIG. 4 is a top plan view showing the ink cartridge according to the first embodiment of the invention.

Referring first to FIGS. 2, 3 and 4, there is shown an ink cartridge according to a first embodiment of the invention, which is removably mounted in an ink jet printer having color printing capability. The illustrated ink cartridge contains inks of three colors: cyan, magenta, and yellow.

As shown in the figures, the ink cartridge 1 includes a cartridge casing 2 which is formed by a lower casing 3 and an upper casing 4 arranged in a manner closing an upper opening of the lower casing 3, and has its interior divided by two partition walls 5 extending upward from a bottom of the lower casing 3 into three ink reservoirs 6, 6, 6 for holding cyan ink, magenta ink, and yellow ink, respectively. The upper and lower casings 3 and 4 are welded together by melting welding material coated on respective contact portions of the two casings 3 and 4, by the use of frictional heat created by rubbing the casings 3 and 4, one against the other, in a vibrating fashion (vibration welding). The ink reservoirs 6 are each filled with ink absorbent 7, and ink charged into the ink cartridge 1 is stored in the ink reservoirs 6 in a state absorbed in the ink absorbent 7.

The lower casing 3 has a bottom portion formed as an ink supply block 8 in which three protruding delivery portions 9, 9, 9 each having a substantially circular cross section are formed in a manner corresponding to the three ink reservoirs 6, 6, 6, respectively. Each of the protruding delivery portions 9 has an ink delivery port 10 opening in a bottom surface thereof, and a supply passage 11 extending from the ink delivery port 10 to the ink reservoir 6. Each supply passage 11 includes a large-diameter portion 11*a* on a downstream side thereof and a small-diameter portion 11*b* on an upstream side thereof. At an upstream opening of the small-diameter portion 11*b*, there is provided a filter 13 in a manner inserted into a hollow cylindrical portion 12 projecting into the ink reservoir 6. In a preferred embodiment, the filter 13 may be separated from the ink absorbent 7, as shown in FIG. 2. As will be described in detail hereinbelow, the ink cartridge 1 is mounted in a print head of a printer in such a manner that an inserting portion, referred to hereinafter, formed on the print head is inserted into the supply passage 11.

The upper casing 4 has three circular ink-charging ports 14, 14, 14 formed therethrough in a manner corresponding to the ink delivery ports 10, 10, 10 of the lower casing 3, respectively. Further, the upper casing 4 has a top surface formed with three air grooves 15, 15, 15 thereon which lead to the respective ink-charging ports 14, 14, 14. Each air groove 15 is formed in a manner meandering over the top surface of the upper casing 4 so as to provide a long path through which air is permitted to flow into the ink cartridge. The three air grooves 15, 15, 15 have end portions thereof extending to a periphery of the upper casing 4 in parallel with each other. As will be described hereinafter, the top surface of the upper casing 4 is designed such that an ink-charging port-covering film 20 is affixed thereto by thermo compression bonding to cover the top surface of the upper casing 4 whereby air inlet passages for the ink reservoirs 6 are defined by the air grooves 15 and portions of the film 20 covering the air grooves 15. The meandering air inlet passages permit a top portion of the inside of each ink reservoir 6 to be communicated with the atmosphere, and at the same time minimize vaporization of water content of the ink via the air inlet passages.

On the other hand, an inner surface of the upper casing 4 has three hollow cylindrical projecting portions 16, 16, 16 extending downward, each of which is formed in a manner concentric with the ink-charging port 14. Further, the inner surface of the upper casing 4 is formed with three pairs of ribs 17, 17, each pair of which are arranged along a longitudinal axis of the ink cartridge in each of the reservoirs on opposite sides of the projecting portion 16. The projecting portions 16 and the ribs 17 hold the ink absorbent 7 lightly depressed downward so as to fix the ink absorbent 7 within the ink reservoir 7 and keep the same from contact with the inner surface of the upper casing 4.

Figure 5A:
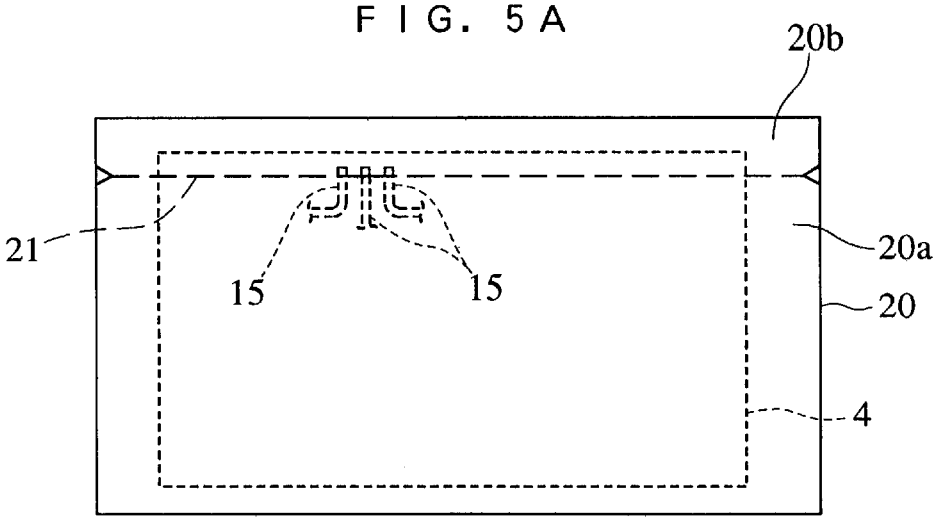
FIG. 5A is a top plan view showing the ink cartridge according to the first embodiment of the invention, which is in storage.
Figure 5B:
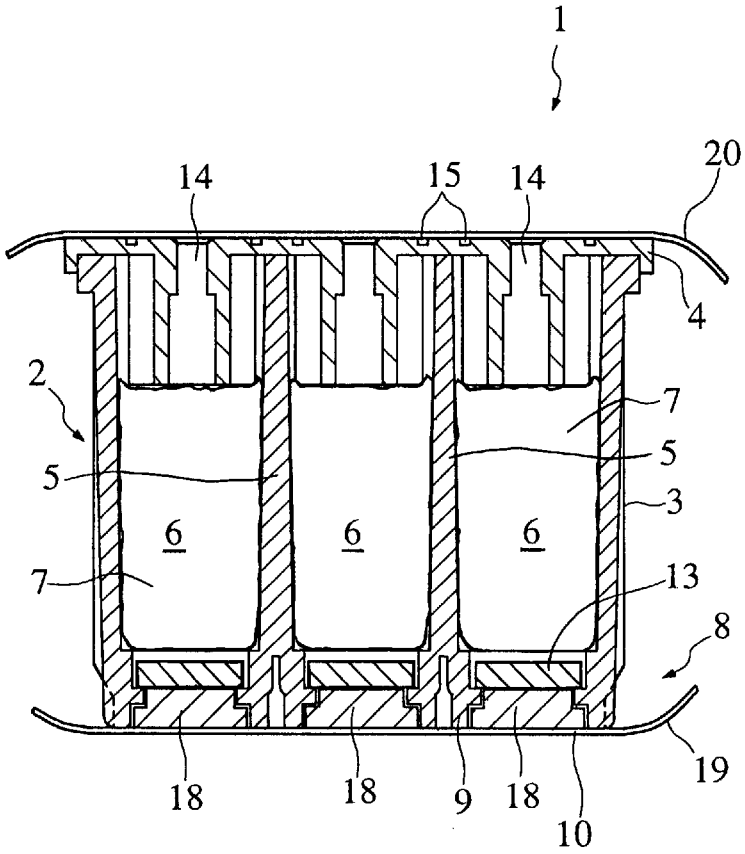
FIG. 5B is a front sectional view showing the ink cartridge according to the first embodiment of the invention, which is in storage.

As shown in FIG. 5B, the ink cartridge 1 constructed as above is supplied to a user, in a state where three lids 18, 18, 18 are mounted therein for blocking the ink delivery ports 10, respectively, with a delivery port-covering film 19 affixed to the cartridge 1 on the side of the delivery port 10 for connecting the lids 18, and the ink-charging port-covering film 20 affixed to the cartridge 1 on the side of the ink-charging port 14. The film 20, which is divided by a cutting line 21 (see FIG. 5A) into a main cover portion 20*a* for covering the three meandering air grooves 15 and an auxiliary cover portion 20*b* for covering the parallel end portions of the air grooves 15, is affixed to the top surface of the upper casing 4 by thermo compression bonding in a state in which the periphery thereof extends beyond an edge of the upper casing 4. The auxiliary cover portion 20*b* is removably affixed to the upper casing 4 by thermo compression boding. When the ink cartridge 4 is mounted in a printer, only the auxiliary cover portion 20*b* is peeled off the upper casing 4 along the cutting line 21, thereby opening the ends of the parallel end portions of the three air grooves (air passage) 15 to the atmosphere.

Each lid 18 is fitted in the supply passage 11 of the lower casing 3 via the ink delivery port 10 with the film 19 firmly affixed to a back surface thereof (see FIG. 2). The lid 18 is formed of rubber, polypropylene, an absorbent material or the like and has a complementary shape to the supply passage 11. Therefore, when the lid 18 is fitted in the supply passage 11, space within the supply passage 11 is filled with the lid 18. Here, it is preferable that the lid 18 is fitted in such that clearance is produced between an upper end face of the lid 18 and the filter 13, so as to prevent damage to the filter 13.

Figure 5C:
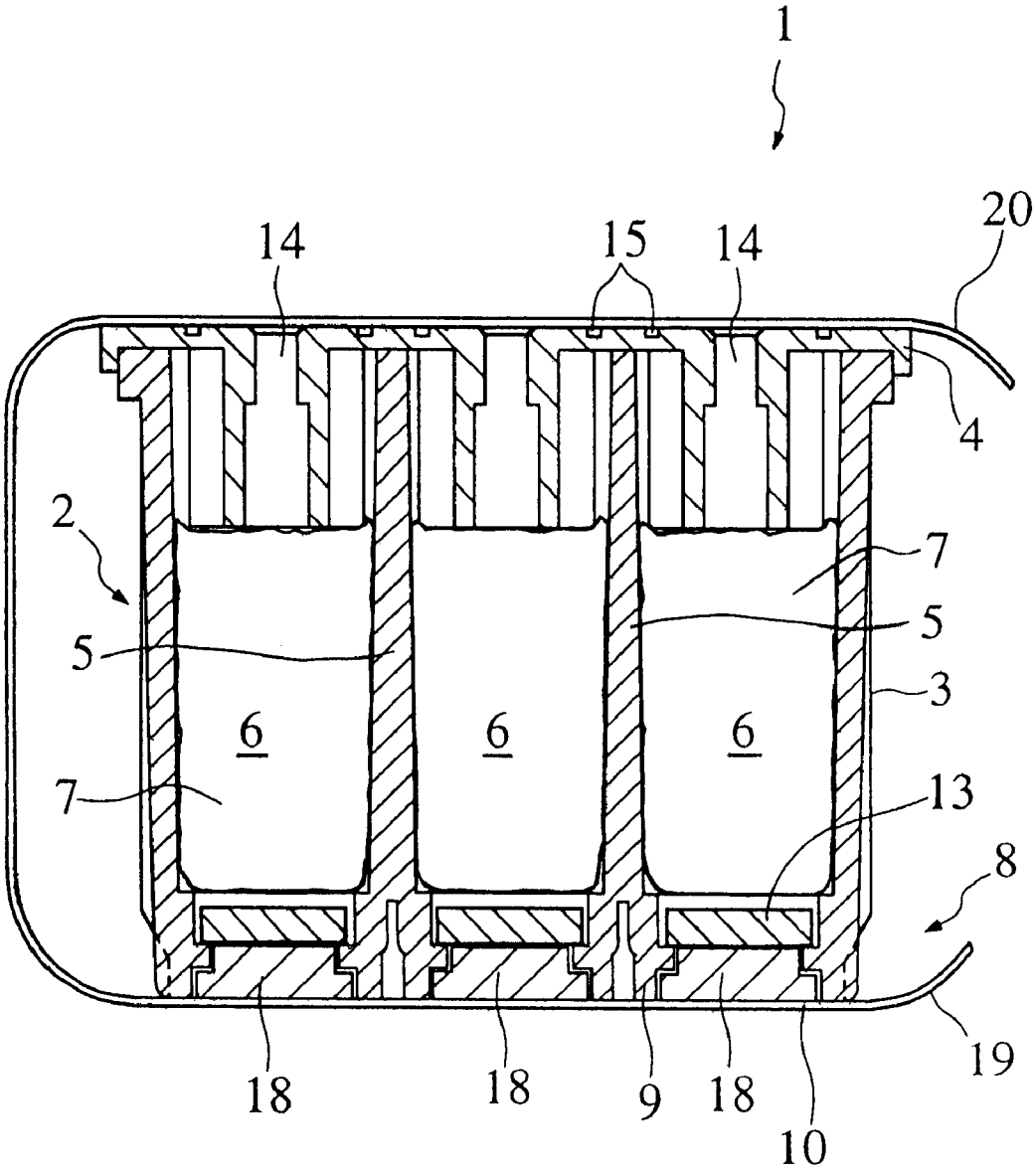
FIG. 5C is a front sectional view showing the ink cartridge according to another embodiment of the present invention, which is in storage.

The film 19 serves as seizing means which enables the user to pull the lids 18 off the ink cartridge 1, and the three lids 18 are secured to a reverse or inner surface of the film 19 in a manner arranged at the same space intervals as the three ink delivery ports 10. The film 19 is removably affixed to an end face of each protruding delivery portion 9 defining the ink delivery port 10 therein, by thermo compression bonding. When the ink cartridge 1 is mounted in a printer, the film 19 is peeled off and removed together with the lids 18 from the ink cartridge 1. It is preferred that the auxiliary cover portion 20*b* of the film 20 is peeled off before removal of the film 19. Alternatively, the film 19 and the film 20 may be formed of the same materiel (e.g. polyethylene terephthalate (PET)) in one piece, as shown in FIG. 5C, such that the film 19 and the auxiliary cover portion 20*b* of the film 20 can be peeled off in a single step.

Figure 6C:
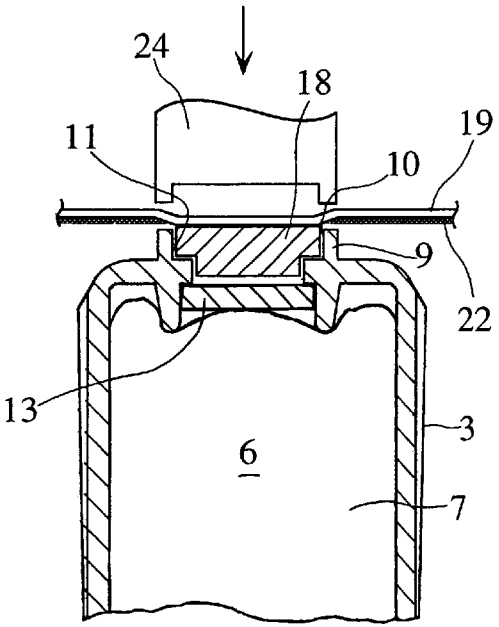
FIGS. 6A to 6C are fragmentary sectional views which are useful in explaining a procedure of assembling the ink cartridge according to the first embodiment of the invention.
Figure 6B:
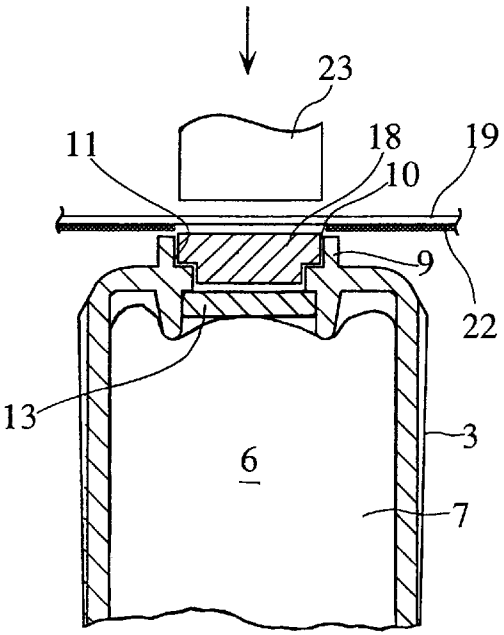
Figure 6A:
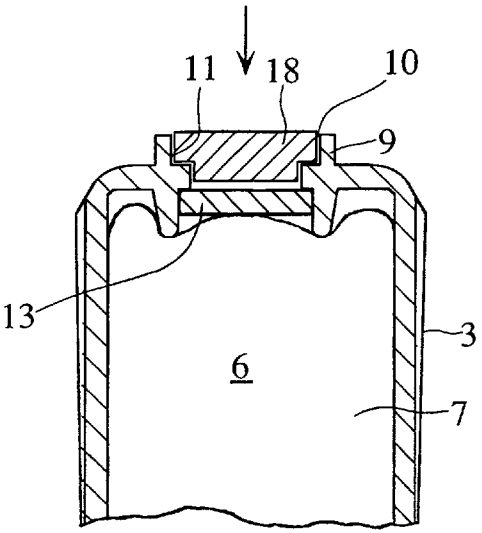

Next, brief description will be made of a procedure of attaching the lids 18 and the film 19 to the cartridge casing 2, with reference to FIGS. 6A to 6C. In this embodiment, the lids 18 are made of polypropylene (PP), while the film 19 is made of polyethylene terephthalate (PET). As shown in FIG. 6A, first, the cartridge casing 2 is set upside down on a table, and then the lids 18 are fitted in the supply passages 11 of the cartridge 1, respectively. Then, the film 19, which is coated with a release agent 22 in advance except the portions to which the lids 18 are to be affixed by thermo compression bonding, is placed or positioned on the cartridge casing 2 (FIG. 6B). Then, a jig 23 for thermo compression bolding of the lids 18 is pressed on the portions of the film 19 which are to be affixed to the lids 18, to thereby fix the lids 18 to the film 19. Thereafter, a jig 24 for thermo compression bonding of the protruding delivery portions 9 is pressed on the portions of the film 19 which are to be affixed to the protruding delivery portions 9, to thereby removably affix the film 19 to the end faces of the protruding delivery portions 9 (FIG. 6C).

Figure 7:
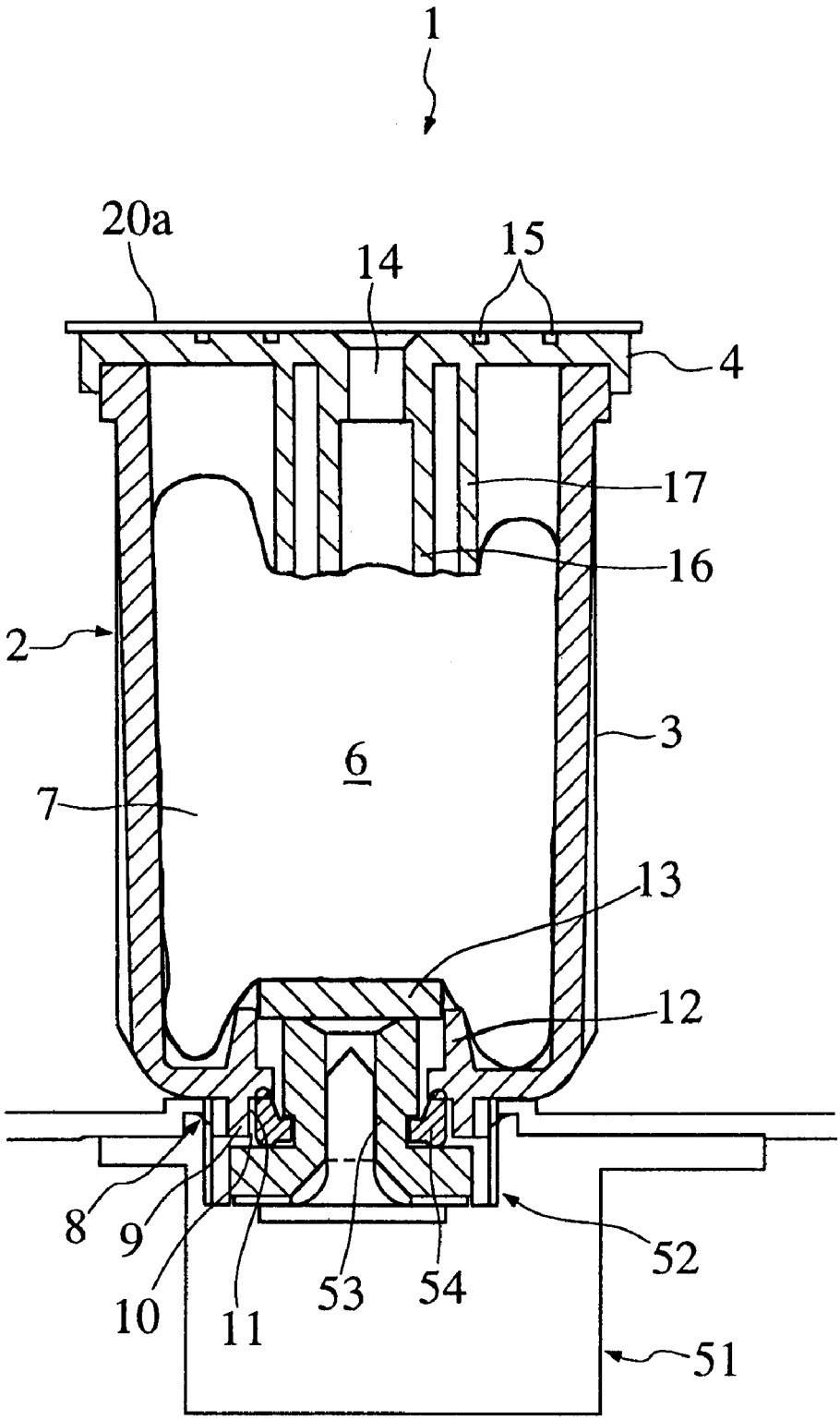
FIG. 7 is a side sectional view showing the ink cartridge according to the first embodiment of the invention, which is mounted in a printer.

FIG. 7 shows the ink cartridge 1 in a state mounted in an ink jet printer after the film 19 and the auxiliary cover portion of the film 20 are removed therefrom. The ink cartridge 1 is mounted in a cartridge socket 52 of a print head 51 of the printer, with its ink supply block 8 facing downward. The print head 51 is formed with an inserting portion 53 for being fitted in the supply passage 11 of the ink cartridge 1. When the ink cartridge 1 is mounted in the ink jet printer, the inserting portion 53 of the print head 51 is inserted deep into the hollow cylindrical portion 12 through the supply passage 11 such that it pushes the filter 13 inward so that the filter 13 is brought into contact with the ink absorbent 7, and at the same time, sealing members 54 of the print head 51 are pressed against inner walls of the supply passage 11. As shown in FIGS. 2, 3, 5B, 8B, 9 and 10, when the ink cartridge is not mounted in the printer, the filter 13 is in a disengaging position and not in contact with the absorbent material 7. The filter 13 is movable between the disengaging position and an engaging position where it is in contact with the absorbent material 7 as shown in FIG. 7. The inserting portion 53 has a mesh filter, not shown, mounted in an open end thereof, which makes it possible to push the filter 13 inward (by approximately 1.5 mm) by the inserting portion 53 to thereby provide appropriate surface contact between the print head 51 and the ink cartridge 1 within the ink passage.

As described above, according to the first embodiment of the invention, since the ink cartridge 1 is stored with the lids 18 respectively mounted in the supply passages 11, it is possible to prevent the ink cartridge 1 from being supplied to a user with ink collected in the supply passages 11. This eliminates fear of ink spilling out when the user removes the lids 18 together with the film 19 and no longer requires collected ink to be removed from the supply passages 11, when he uses the ink cartridge 1. Therefore, the user can handle the ink cartridge 1 with ease.

Further, since the three lids 18 are secured to the film 19, it is possible to remove the three lids 18 together simply by peeling off the film 19, which facilitates handling of the ink cartridge 1. Still further, since the film 19 is thermo compression bonded to the end faces of the protruding delivery portions 9, ink is positively prevented from leaking through clearance between the lid 18 and the supply passage 11 due to vibration or the like.

Figure 8A:
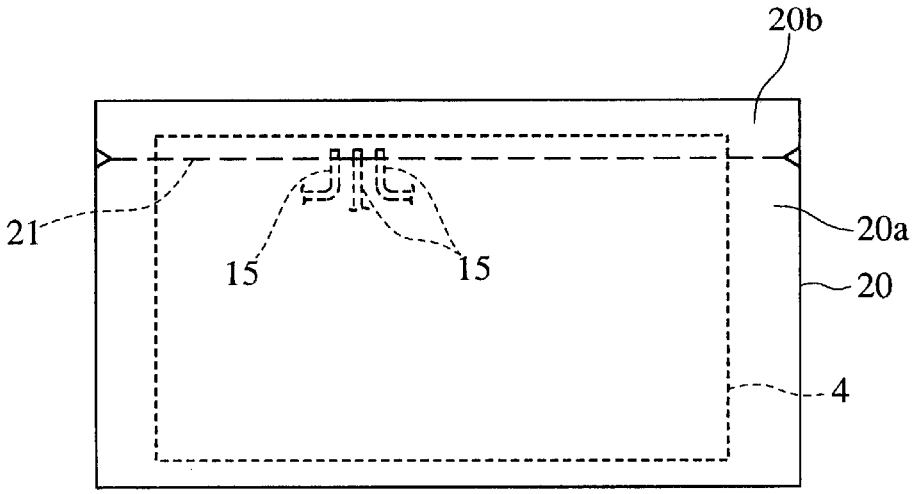
FIG. 8A is a top plan view showing an ink cartridge, according a second embodiment of the invention, which is in storage.
Figure 8B:
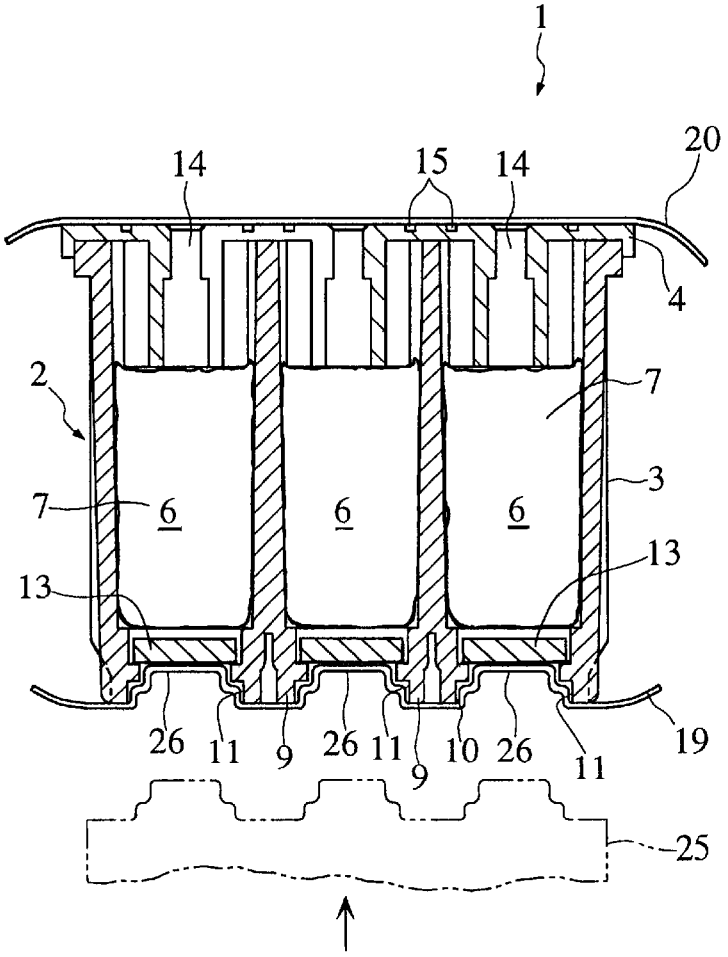
FIG. 8B is a front sectional view showing the ink cartridge according to the second embodiment of the invention, which is in storage.

Next, a second embodiment of the invention will be described with reference to FIGS. 8A and 8B. In this embodiment, a delivery port-covering film 19 plays the role of the lids 18 of the above embodiment as well as its original role. More specifically, as shown in FIG. 8B, the film 19 is placed such that it covers ink delivery ports 10, and thereafter the film 19 is pressed against the ink cartridge 1 by a jig 25 for thermo compression bonding of the film 19. The jig 25 has an end portion complementary to the bottom of the ink cartridge 1 which includes supply passages 11 and end faces of protruding delivery portions 9. The film 19 is thermo compression bonded to the bottom of the ink cartridge 1 in a drawing-like manner to form a complementary profile. Thus, the film 19 is formed with three lid portions (thin members) 26, 26, 26 each having a complementary shape to the inner walls of the supply passage 11, and fitted in the supply passage 11. Further, the supply passages 11 are completely sealed by the thermo compression bonding of the film 19. In the present embodiment, it is preferable that the film 19 has a thickness at which the film 19 is more preferably or properly called "a delivery port covering sheet" in exact meaning of the terms. Further, the film 19 may be formed, in advance, with three portions each shaped complementary to the portion including the inner wall of the supply passage 11 and the end face of the protruding delivery portion 9, and thereafter affixed to the bottom of the cartridge such that these portions are fitted in the supply passages 11 and bonded thereto by thermo compression bonding.

As described above, according to the second embodiment of the invention, the lid portions 26 each formed of part of the film 19 by thermo compression bonding to the inner shape of the supply passage 11 of the ink cartridge 1 are fitted in the supply passages 11, respectively. Therefore, when the user peels off the film 19 so as to use the ink cartridge 1, there is no ink collected within the supply passages 11, and hence there is no fear of ink spilling out of the cartridge 1. Therefore, the user is no longer required to remove ink collected in the supply passages 11 before the cartridge is mounted in a printer. Further, according to the present embodiment, it is possible to remove the three lid portions 26 in a single step by peeling off the delivery port-covering film 19. Still further, since the lid portions 26 of the delivery port-covering film 19 are affixed to the supply passages 11 and the end faces of the protruding delivery portions 9 by thermo compression bonding, ink is positively prevented from leaking out of the cartridge 1 due to vibration or the like. In addition, it is possible to reduce the number of component parts of the cartridge 1. In this embodiment, similarly to the first embodiment, the film 19 and the film 20 may be formed of the same material in one piece such that the film 19 and an auxiliary cover portion 20*b* of the film 20 can be peeled off together in a single step.

Figure 9:
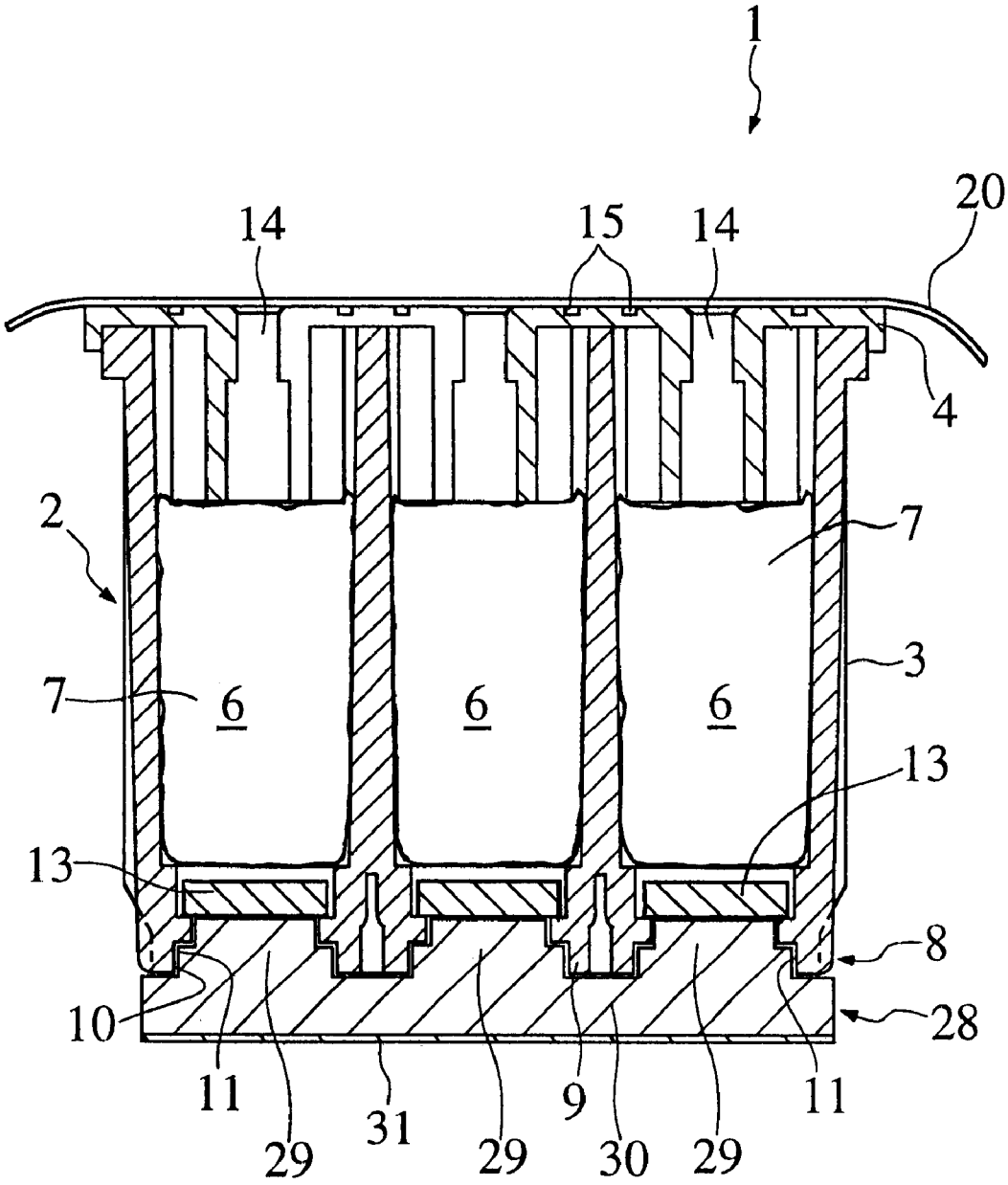
FIG. 9 is a front sectional view showing an ink cartridge according to a third embodiment of the invention, which is in storage.

Next, a third embodiment of the invention will be described with reference to FIG. 9. This embodiment is distinguished from the first embodiment, in which three separate lids are employed, in that three similarly-shaped lids are unitized as a sealing cap 28 for sealing supply passages 11. More specifically, the sealing cap 28 is formed of butyl rubber or the like and includes three lids 29, 29, 29 for being fitted in respective supply passages 11 and a cap body 30 integrally formed with the three lids 29, 29, 29. Further, the sealing cap 28 has a double-sided adhesive tape 31 adhered to a back thereof. The lid portions 29 of the sealing cap 28 are firmly fitted in the supply passages 11, respectively, for sealing the same.

Figure 10:
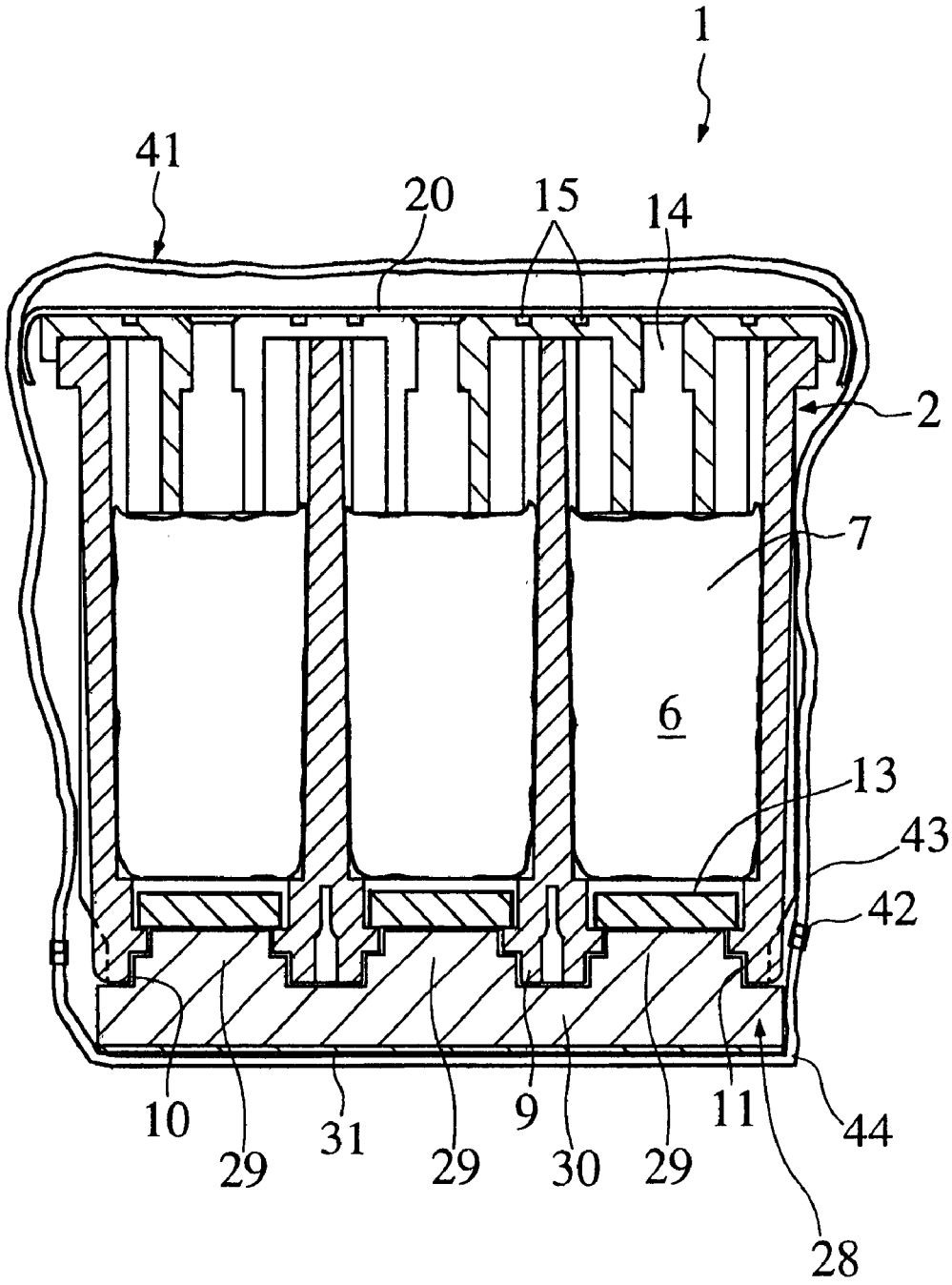
FIG. 10 is a front sectional view showing the ink cartridge according to the third embodiment of the invention, which is enclosed in a sealed package.

As shown in FIG. 10, the ink cartridge 1 constructed as above is enclosed within a sealed package 4 onto which aluminum foil is deposited, and in this state supplied to users. The package 41 is divided into an upper bag 43 and a lower bag 44, and the two bags 43 and 44 are fastened to each other by a sealing tape 42. The ink cartridge 1 is secured to an inner bottom surface of the lower bag 44 by the double-sided adhesive tape 31 adhered to the sealing cap 28. When the ink cartridge 1 is taken out of the package 41, first, the sealing tape 42 is peeled off to thereby open the package 41. Then, the upper bag 43 is removed, and finally the lower bag 44 is removed together with the sealing cap 28 secured thereto.

Now, brief description will be made of assembling procedure from a step of charging ink into the ink cartridge 1 to a step of enclosing the same within the package 41. First, the sealing cap 28 is mounted in the ink cartridge 1. Then, the ink cartridge 1 having the sealing cap 28 fitted therein is placed in a vacuum chamber (desiccator), and the ink absorbent 7 is deaerated by reducing pressure within the vacuum chamber with the sealing cap 28 being pressed in firmly. When deaeration of the ink absorbent 7 is completed, the vacuum chamber is made open to the atmosphere, and at the same time, inks are charged into the ink reservoirs 6 of the ink cartridge 1, respectively. Then, an ink-charging port-covering film 20 is affixed to the cartridge 1 by thermo compression bonding. Thereafter, release paper is peeled off the double-sided adhesive tape 31 adhered to the sealing cap 28, and the ink cartridge 1 is inserted into the package 41 from the upper opening of the upper bag 43. Subsequently, the double-sided adhesive tape 31 is adhered to the inner bottom surface of the lower bag 44, the package 41 is evacuated, and finally, the opening of the upper bag 43 is sealed by thermo compression bonding.

According to the above construction, through operations of taking the ink cartridge 1 out of the package 41, the lid members 29 are removed from the cartridge 1 together with the sealing cap 28, which makes it possible to positively prevent the ink cartridge 1 from being carelessly mounted in a printer with the lids remaining fitted in the cartridge 1.

Also, the end portions of the auxiliary cover portion 20*b* of the film 20 may be adhered or affixed to the inner surface of the upper bag 43, whereby the auxiliary cover portion 20*b* may be peeled off at the same time when the upper bag 43 is removed from the ink cartridge 1. Further, in the first and second embodiments, the film 19 may be adhered or affixed to the lower bag 44, or the film 19 may be constructed to form part of the lower bag 44 as well. Although in the above embodiments, description has been made of the ink cartridge 1 which has three ink reservoirs 6, this is not limitative.

It is further understood by those skilled in the art that the foregoing are preferred embodiments of the invention, and that various changes and modification may be made thereto without departing from the spirit and scope thereof.

What is claimed is:

1. An ink cartridge for a printer, comprising:

an ink supply block having a bottom, a sleeve section protruding from the bottom, a delivery port opening in the sleeve section of the bottom, and a supply passage extending from said delivery port to an inside of said ink supply block, the supply passage being partially formed by the sleeve section and defining an upstream end opposite to the delivery port;

a filter provided adjacent to the upstream end of said supply passage; and a lid member having a peripheral portion removably affixed to an end of the sleeve section protruding from the bottom, and a lid portion extending to the upstream end of said supply passage and having a complementary shape to said supply passage and removably mounted in said supply passage from said delivery port;

wherein said peripheral portion and said lid portion of said lid member is formed by a single thin member of a sheet material.

2. An ink cartridge according to claim 1, wherein said lid portion is formed by a solid member for blocking said supply passage.

3. An ink cartridge according to claim 1, wherein said peripheral portion of said lid member extends beyond an edge of said bottom of said ink supply block.

4. An ink cartridge according to claim 1, including an ink-charging block having an air inlet port and a cover film removably affixed to the ink-charging block and covering the air inlet port of said ink-charging block, said lid member being affixed to said supply block, and said cover film and said lid member being formed in one piece.

5. An ink cartridge according to claim 1, wherein said thin member is formed of a thin sheet of material.

6. An ink cartridge according to claim 5, wherein said thin sheet of material is made of polyethylene terephthalate.

7. An ink cartridge according to claim 1, wherein said lid member formed by the thin member is affixed to said bottom of said ink supply block after the complementary shape is formed in said lid member.

8. An ink cartridge according to claim 1, wherein said ink cartridge comprises an air port and an ink absorbent provided therein.

9. An ink cartridge according to claim 8, wherein the ink cartridge is contained in a package made of aluminum film.

10. An ink cartridge for a printer according to claim 1, wherein the ink cartridge comprises an upper case including an air inlet port, a winding air passage defined in the upper casing and communicating with the air inlet port and a lower case having a chamber containing an ink absorbent material for storing ink therein, wherein the winding air passage is defined by a winding open groove formed in a top surface of the upper casing and a film disposed over the winding open groove, at least a portion of the film being removably affixed to the top surface of the upper casing.

11. An ink cartridge for a printer according to claim 10, wherein the winding open groove has an inlet opening section located at a distance from the air inlet port, and wherein the film has two sections divided by a cut line, one of the two sections of the film covering only the inlet opening section of the winding open groove.

12. An ink cartridge for a printer according to claim 1, wherein the ink supply block comprises a chamber containing an ink absorbent material, and the filter is movably disposed in said supply passage between a disengaging position in which the filter is separated from the absorbent material and an engaging position in which the filter is in contact with the absorbent material.

13. An ink cartridge for a printer according to claim 1, wherein the ink supply block comprises a plurality of chambers each having a supply passage and containing an ink absorbent material, and a plurality of filters each movably disposed in one of the supply passages between a disengaging position in which the filter is separated from the corresponding absorbent material and an engaging position in which the filter is in contact with the corresponding absorbent material.

* * * * *